US005666617A

United States Patent [19]

Goodman et al.

[11] Patent Number: 5,666,617

[45] Date of Patent: Sep. 9, 1997

[54] LID MACHINE HAVING A DIFFERENTIAL AIR PRESSURE ASSISTED BLOTTING DEVICE

[75] Inventors: Nancy B. Goodman, Webster; John F. Knapp, Fairport; Shu Chang, Webster, all of N.Y.

[73] Assignee: Xerox Corporation, Stamford, Conn.

[21] Appl. No.: 625,386

[22] Filed: Apr. 1, 1996

[51] Int. Cl.[6] ..... G03G 21/00

[52] U.S. Cl. ..... 399/250; 399/227

[58] Field of Search ..... 355/256, 273; 118/652, 659–662; 399/57, 237, 249, 250

[56] References Cited

U.S. PATENT DOCUMENTS

| | | | |
|---|---|---|---|
| 4,286,039 | 8/1981 | Landa et al. | 430/119 |
| 4,985,733 | 1/1991 | Kurotori et al. | 355/282 |
| 5,136,334 | 8/1992 | Camis et al. | 355/256 |
| 5,332,642 | 7/1994 | Simms et al. | 430/125 |
| 5,352,558 | 10/1994 | Simms et al. | 355/256 X |

*Primary Examiner*—Arthur T. Grimley
*Attorney, Agent, or Firm*—Tallam Nguti

[57] ABSTRACT

A high differential air pressure assisted blotting device for conditioning, on an image bearing member, liquid developer images consisting of charged toner particles and carrier liquid. The high differential air pressure blotting device includes a movable porous blotter belt forming an endless loop and having an outer surface for contacting and blotting carrier liquid from an image being conditioned, and a backup roller positioned at a first location within the endless loop for contacting a first portion of the blotter belt to gently urge the blotter belt into blotting-contact with the image being conditioned. Importantly, the high differential air pressure blotting device includes a high differential air pressure assembly positioned at a second location spaced from the image being conditioned so as not to disturb the image, and from the first location for contacting a second portion of the blotter belt and applying a high differential air pressure to such second portion to force carrier liquid out of the blotter belt before such second portion recontacts an image being conditioned.

9 Claims, 5 Drawing Sheets

LID MACHINE HAVING A DIFFERENTIAL AIR PRESSURE ASSISTED BLOTTING DEVICE

BACKGROUND AND MATERIAL DISCLOSURE STATEMENT

This invention relates to electrostatographic reproduction machines, and more particularly to a liquid immersion development (LID) electrophotographic reproduction machine having a highly effective high differential air pressure assisted image blotting device.

Liquid electrophotographic reproduction machines are well known, and generally each include a development system that utilizes a liquid developer material typically having about 2 percent by weight of fine solid particulate toner material dispersed in a liquid carrier. The liquid carrier is typically a hydrocarbon. In the electrophotographic process of such a machine, a latent image formed on an image bearing member or photoreceptor is developed with the liquid developer material. The developed image on the photoreceptor typically contains about 12 percent by weight of particulate toner in liquid hydrocarbon carrier. To improve the quality of transfer of the developed image to a receiver, the image is conditioned so as to increase the percent solids of the liquid developer forming the image to about 25 percent. Such conditioning is achieved by removing excess hydrocarbon liquid from the developed liquid image. However, such removal must be carried out in a manner that results in minimum degradation of the toner particles forming the liquid image. The conditioned image is then subsequently transferred to a receiver which may be an intermediate transfer belt and then to a recording or copy sheet for fusing to form a hard copy.

Liquid electrophotographic reproduction machines as such can produce single color images or multicolor images on such a recording or copy sheet. The quality or acceptability of a color copy produced as such is ordinarily a function on how the human eye and mind receives and perceives the colors of the original and compares it to the colors of the copy. The human eye has three color receptors that sense red light, green light, and blue light. These colors are known as the three primary colors of light. These colors can be reproduced by one of two methods, additive color mixing and subtractive color mixing, depending on the way the colored object emits or reflects light.

In the method of additive color mixing, light of the three primary colors is projected onto a white screen and mixed together to create various colors. A well known exemplary device that uses the additive color method is the color television. In the subtractive color method, colors are created from the three colors yellow, magenta and cyan, that are complementary to the three primary colors. The method involves progressively subtracting light from white light. Examples of subtractive color mixing are color photography and color reproduction. Also, it has been found that electrophotographic reproduction machines are capable of building up a full subtractive color image from cyan, magenta, yellow and black. They can produce a subtractive color image by one of three methods.

One method is to transfer the developed image of each color on an intermediary, such as a belt or drum, then transferring all the images superimposed on each other on a sheet of copy paper.

A second method involves developing and transferring an image onto a sheet of copy paper, then superimposing a second and subsequent images onto the same sheet of copy paper. Typically an image processing system using this method can produce a first color image by developing that color image on a photoconductive surface, transferring the image onto a sheet of copy paper, and then similarly and sequentially producing and superimposing a second, and subsequent images onto the same sheet of copy paper.

A third method utilizes what is referred to as a Recharge, Expose, and Develop or REaD process. In this process, the light reflected from the original is first converted into an electrical signal by a raster input scanner (RIS), subjected to image processing, then reconverted into a light, pixel by pixel, by a raster output scanner (ROS) which exposes the charged photoconductive surface to record a latent image thereon corresponding to the subtractive color of one of the colors of the appropriately colored toner particles at a first development station. The photoconductive surface with the developed image thereon is recharged and re-exposed to record the latent image thereon corresponding to the subtractive primary of another color of the original. This latent image is developed with appropriately colored toner. This process (REaD) is repeated until all the different color toner layers are deposited in superimposed registration with one another on the photoconductive surface. The multi-layered toner image is transferred from the photoconductive surface to a sheet of copy paper. Thereafter, the toner image is fused to the sheet of copy paper to form a color copy of the original.

Liquid developer typically contains about 2 percent by weight of fine solid particulate toner material that is dispersed in a carrier liquid, such as a hydrocarbon. The developed image on the imaging member or photoreceptor ordinarily contains about 12 weight percent of particulate toner material or particles in the hydrocarbon carrier liquid. Conditioning such an image therefore includes increasing the percent solids of the image by removing carrier liquid from the image while preventing the solid toner particles from leaving the image, and of electrostatically compressing or compacting the toner particles in order to physically stabilize the image, and produce a clear, high resolution image.

Such conditioning must however be achieved without disturbing the toner image, and in such a manner as to prevent toner particles from entering the carrier liquid removal device. In addition, the carrier liquid removal device must also remain clean and free of toner particles so as to prevent it from thereafter contaminating a subsequent image with embedded toner particles, and so as to ensure an extended useful life for the device.

Various techniques and devices including blotter rolls or rollers have been devised for conditioning the liquid developer image by removing carrier liquid from the image as discussed above. Such blotter rolls may include a vacuum removal system and an electrical bias applied thereto in order to assist the removal process. The following references may be relevant to various aspects of the present invention.

U.S. Pat. No. 4,286,039 discloses an image forming apparatus comprising a deformable polyurethane roller, which may be a squeegee roller or blotting roller which is biased by a potential having a sign the same as the sign of the charged toner particles in a liquid developer. The bias on the polyurethane roller is such that it prevents streaking, smearing, tailing or distortion of the developed electrostatic image and removes much of the carrier liquid of the liquid developer from the surface of the photoconductor.

U.S. Pat. No. 4,985,733 issued Jan. 15, 1991, to Kurotori et. al. discloses a liquid toner copying machine including a non-thermal image conditioning apparatus comprising an elastic blotter roll and an elastic backup roller for bringing a liquid toner image carrying sheet into contact with the blotter roll.

U.S. Pat. No. 5,136,334 issued Aug. 4, 1992, to Camis et. al. discloses a liquid toner image conditioning apparatus including a heated inner core connected to a source of AC or DC bias, and having a smooth outer surface made of a soft elastomeric material.

U.S. Pat. No. 5,332,642, having a common assignee as the present application, discloses a porous roller for increasing the solids content of an image formed from a liquid developer. The liquid dispersant absorbed through the roller is vacuumed out through a central cavity of the roller. The roller core and/or the absorbent material formed around the core may be biased with the same charge as the toner so that the toner is repelled from the roller while the dispersant is absorbed.

Each of the above example references includes a currently conventional blotter roller having a rigid core, and at least an absorbent layer over such core with the blotter roll mounted in a LID machine to directly contact a liquid toner image on the image bearing member of the reproduction machine. A conventional blotting device assembly that includes such a blotter roll, often has an assisting vacuum source connected to the core of the blotter roll for vacuum-drawing carrier liquid from an image being conditioned, through and out of the blotter roll.

It has been found that conventional blotting assemblies or devices as such are ordinarily limited by their absorbency capacity and by a need to apply a non-image disturbing level of vacuum (usually a partial vacuum) with respect to the degree to which each can remove carrier liquid from an image being conditioned. Because the blotter roll in such a device is typically made of a thin wall, sintered metal tube, a force with which it can be loaded against the image being conditioned, is also limiting. This of course also limits the effective blotting results of the device. Furthermore, because vacuum is applied directly against the image being conditioned, there is understandably the risk of image disturbance, and of early blotter roll failure from toner particles being sucked from the image into the pores of the surface layer of the blotter roll. Another undesirable effect of applying vacuum directly against an image being conditioned by a blotter roll having pore and non-pore surface layer areas that contact the image, can be a non-uniform appearance in the image between areas thereof contacted by pore surface layer areas, and those contacted by non-pore surface layer areas of the blotter roll.

There is therefore a need for developing a LID image blotting method and apparatus for achieving highly effective, uniform and non-disturbing image blotting without the above cited limitations.

SUMMARY OF THE INVENTION

In accordance with the present invention, there is provided a high differential air pressure assisted blotting device for conditioning, on an image bearing member, liquid developer images consisting of charged toner particles and carrier liquid. The high differential air pressure blotting device includes a movable porous blotter belt forming an endless loop and having an outer surface for contacting and blotting carrier liquid from an image being conditioned, and a backup roller positioned at a first location within the endless loop for contacting a first portion of the blotter belt to gently urge the blotter belt into blotting-contact with the image being conditioned. Importantly, the high differential air pressure blotting device includes a high differential air pressure assembly positioned at a second location spaced from the image being conditioned so as not to disturb the image, and from the first location for contacting a second portion of the blotter belt and applying a high differential air pressure to such second portion to force carrier liquid out of the blotter belt before such second portion recontacts an image being conditioned.

BRIEF DESCRIPTION OF THE DRAWINGS

In the detailed description of the invention presented below, reference is made to the drawings, in which.

DESCRIPTION OF THE INVENTION

Figure 1:
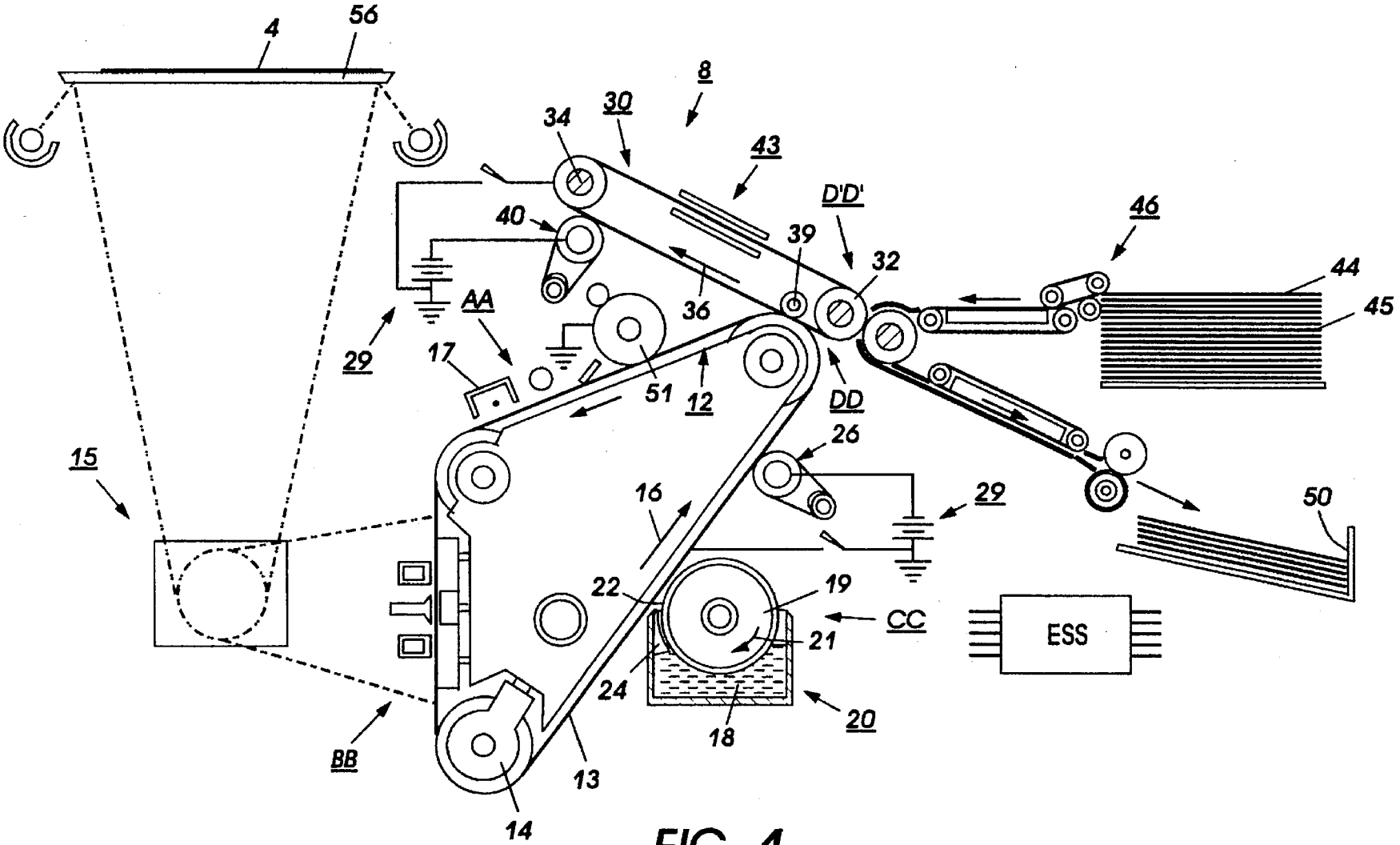
FIG. 1 is a schematic, elevation illustration of an exemplary single color black and white electrophotographic liquid toner reproduction machine incorporating the high differential air pressure assisted blotting device in accordance with the present invention.

For a general understanding of the features of the present invention, reference numerals have been used throughout to designate identical elements. It will become evident from the following discussion that the present invention is equally well suited for use in a wide variety of reproduction machines, such as light lens copiers, digital copiers and printers, and is not necessarily limited in its application to only the particular exemplary embodiment depicted herein.

Inasmuch as the art of electrophotographic reproduction is well known, the various processing stations employed in the FIGS. 1 and 2 reproduction machines will be shown hereinafter only schematically, and their operation described only briefly.

Referring to FIG. 1, there is shown a reproduction machine 8 employing a belt 12 including a photoconductive surface 13 deposited on a conductive substrate. A roller 14 rotates and advances belt 12 in the direction of arrow 16. Belt 12 passes through charging station AA where a corona generating device 17 charges the photoconductive surface 13 of the belt 12 a portion at a time to a high and generally uniform potential. The charged portions of belt 12 are advanced sequentially to an exposure station BB where image rays from an original document 4 on a transparent platen 56 are projected by means of an optical system 15 onto the charged portion of the photoconductive surface so as to record an electrostatic latent image. Alternatively as is well known, a raster output scanner (ROS) device (not shown) can be used to write a latent image bitmap from digital electronic data by selectively erasing charges in areas of a charged portion on the charged belt 12. Such a ROS device writes the image data pixel by pixel in a line screen registration mode. In either case, it should be noted that the latent image can be thus formed for a discharged area development (DAD) process machine in which discharged areas are developed with toner, or for a charged area development (CAD) process machine in which the charged areas are developed with toner.

After the electrostatic latent image has been recorded thus, belt 12 advances to development station CC where a liquid developer material 18 including liquid carrier and charged toner particles from a chamber of a development apparatus 20 is advanced through a development zone or nip 22. At development station CC, a developer roller 19 rotating in the direction of arrow 21 advances liquid developer material 18 through the nip 22. An electrode 24 positioned before an entrance into development nip 22 is electrically biased so as to disperse the toner particles as solids in a substantially uniformly manner throughout the liquid carrier.

Development station CC also includes a highly effective, high differential air pressure assisted blotting device 26 in accordance with the present invention, for achieving uniform removal of carrier liquid from LID images on the image bearing surface. High differential air pressure assisted blotting device 26, made in accordance with the method of the present invention (to be discussed in detail below) is mounted so as to contact the liquid toner developed image on belt 12, and so as to condition the liquid image by reducing its fluid content at a point spaced from the image without risk of damage to the image.

After the electrostatic latent image is developed and conditioned by the device 26, belt 12 advances the conditioned image to transfer station DD where the conditioned liquid image is electrostatically transferred from belt 12 to a copy substrate such as a copy sheet (not shown) or as shown to an intermediate member or belt 30. The belt 30 is entrained about rollers 32 and 34, and is moved in the direction of arrow 36. A bias transfer roller 39 urges intermediate transfer belt 30 against image bearing belt 12 in order to assure effective transfer of the conditioned liquid toner image from belt 12 to the intermediate belt 30.

A second high differential air pressure assisted blotting device 40 that is also made in accordance with the method of the present invention (to be described below). The high differential air pressure assisted blotting device 40 contacts the transferred image on belt 30 to further reduce its fluid content (increasing its percent solids) while preventing toner particles from departing from the image. The high differential air pressure assisted device 40 thus creates a high solids content image by further removing excess liquid carrier and increasing the percent solids of the image to between 25 and 75. % by weight, for example. Increasing the percent solids of the transferred liquid toner image on the intermediate belt 30 as such is a particularly important function in a liquid color image developing process that utilizes multiple superimposed images of different colors.

Belt 30 then advances the high solids conditioned image through a heating device 43 to a second transfer station D'D' where a sheet of support material 44 is advanced from stack 45 of such sheets by a sheet transport mechanism 46. The transferred image from the photoconductive surface of belt 30 is then attracted or transferred to a copy sheet 44. After such transfer a, conveyor belt 46 moves the copy sheet 44 to a discharge output tray 50. As shown, after toner image transfer at transfer station DD, a cleaning device 51 including a roller formed of suitable material is driven into scrubbing engagement with the surface 13 of belt 12 in order to clean the surface 13.

Figure 2:
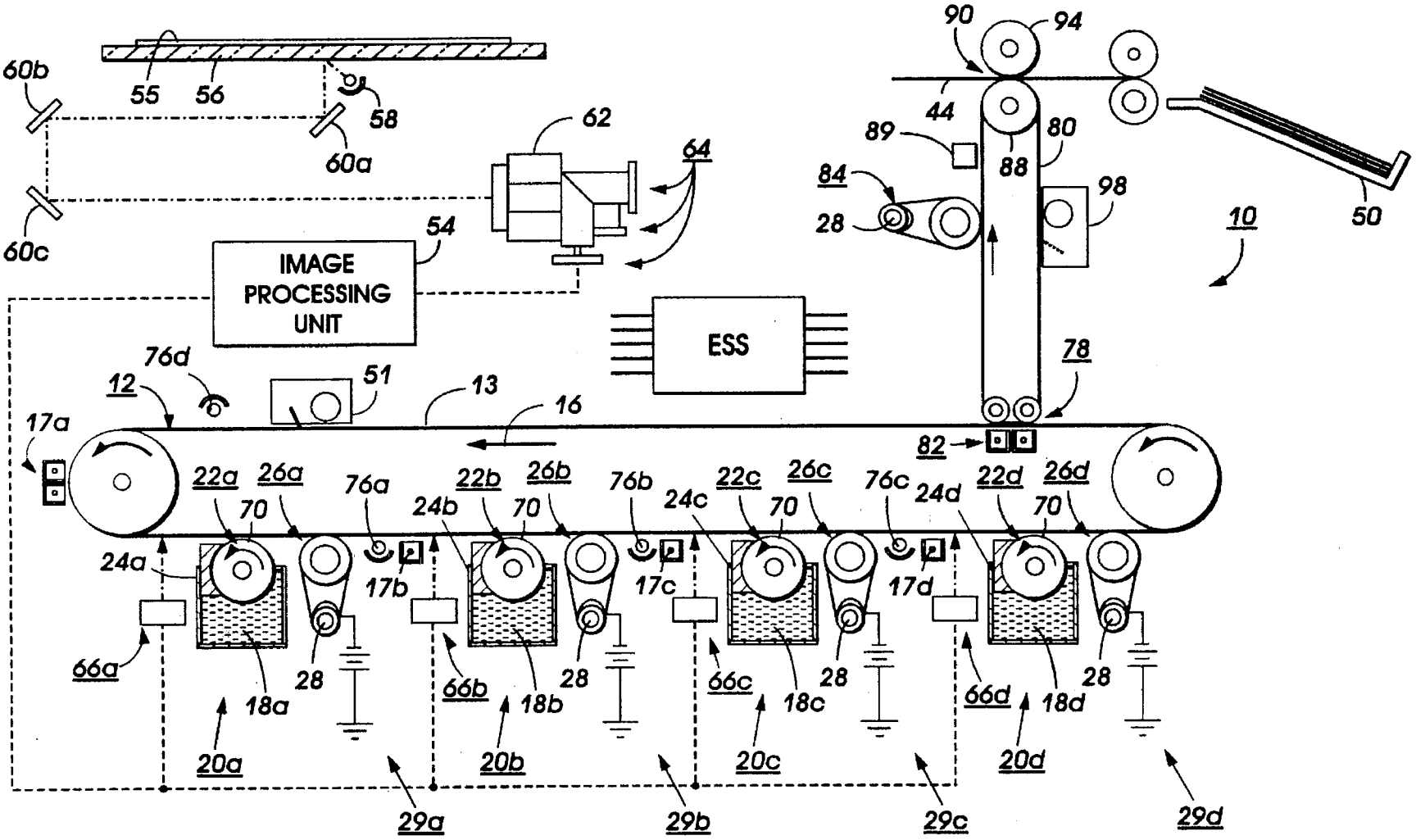
FIG. 2 is a schematic elevational illustration of an exemplary color electrophotographic liquid toner reproduction machine incorporating the high differential air pressure assisted blotting device in accordance with the present invention.

Turning now to FIG. 2, there is shown a color electrophotographic reproduction machine 10 incorporating post-transfix fusing apparatus of the present invention. The color copy process of the machine 10 can begin by either inputting a computer generated color image into an image processing unit 54 or by way of example, placing a color document 55 to be copied on the surface of a transparent platen 56. A scanning assembly consisting of a halogen or tungsten lamp 58 which is used as a light source, and the light from it is exposed onto the color document 55. The light reflected from the color document 55 is reflected, for example, by a 1st, 2nd, and 3rd mirrors 60*a*, 60*b*and 60*c*, respectively through a set of lenses (not shown) and through a dichroic prism 62 to three charged-coupled devices (CCDs) 64 where the information is read. The reflected light is separated into the three primary colors by the dichroic prism 62 and the CCDs 64. Each CCD 64 outputs an analog voltage which is proportional to the intensity of the incident light. The analog signal from each CCD 64 is converted into an 8-bit digital signal for each pixel (picture element) by an analog/digital converter (not shown). Each digital signal enters an image processing unit 54. The digital signals which represent the blue, green, and red density signals are converted in the image processing unit 54 into four bitmaps: yellow (Y), cyan (C), magenta (M), and black (Bk). The bitmap represents the value of exposure for each pixel, the color components as well as the color separation. Image processing unit 54 may contain a shading correction unit, an undercolor removal unit (UCR), a masking unit, a dithering unit, a gray level processing unit, and other imaging processing subsystems known in the art. The image processing unit 54 can store bitmap information for subsequent images or can operate in a real time mode.

The machine 10 includes a photoconductive imaging member or photoconductive belt 12 which is typically multilayered and has a substrate, a conductive layer, an optional adhesive layer, an optional hole blocking layer, a charge generating layer, a charge transport layer, a photoconductive surface 13, and, in some embodiments, an anti-curl backing layer. As shown, belt 12 is movable in the direction of arrow 16. The moving belt 12 is first charged by a charging unit 17*a*. A raster output scanner (ROS) device 66*a*, controlled by image processing unit 54, then writes a first complementary color image bitmap information by selectively erasing charges on the charged belt 12. The ROS 66*a* writes the image information pixel by pixel in a line screen registration mode. It should be noted that either discharged area development (DAD) can be employed in which discharged portions are developed or charged area development (CAD) can be employed in which the charged portions are developed with toner.

After the electrostatic latent image has been recorded thus, belt 12 advances the electrostatic latent image to development station 20*a*. At development station 20a, a development roller 70, rotating in the direction as shown, advances a liquid developer material 18*a*, preferably black toner developer material, from the chamber of a development housing to a development zone or nip 22*a*. An electrode 24*a* positioned before the entrance to development zone or nip 22*a* is electrically biased to generate an AC field just prior to the entrance to development zone or nip 22*a* so as to disperse the toner particles substantially uniformly throughout the liquid carrier. The toner particles, disseminated through the liquid carrier, pass by electrophoresis to the electrostatic latent image. As is well known, the charge of the toner particles is opposite in polarity to the charge on the photoconductive surface 13.

After the first liquid color separation image is developed, for example with black liquid toner, it is conditioned by a high differential air pressure assisted device 26a made in accordance with the present invention (to be described in detail below). High differential air pressure assisted device 26a contacts the developed image on belt 12 and conditions the image by compacting the toner particles of the image and reducing the fluid content thereof (thus increasing the percent solids) while inhibiting the departure of toner particles from the image. Preferably, the percent solids in the developed image is increased to more than 20 percent by weight. The image on belt 12 then advances to lamp 76a where any residual charge left on the photoconductive surface 13 of belt 12 is erased by flooding the photoconductive surface with light from lamp 76a.

As shown, according to the REaD (Recharge Erase and Develop) electrostatographic process of the machine 10, the developed latent image on belt 12 is subsequently recharged with charging unit 17b, and is next re-exposed by ROS 66b. ROS 66b superimposing a second color image bitmap information over the previous developed latent image. Preferably, for each subsequent exposure an adaptive exposure processor is employed that modulates the exposure level of the raster output scanner (ROS) for a given pixel as a function of toner previously developed at the pixel site, thereby allowing toner layers to be made independent of each other. Also, during subsequent exposure, the image is re-exposed in a line screen registration oriented along the process or slow scan direction. This orientation reduces motion quality errors and allows the utilization of near perfect transverse registration. At development station 20b, a development roller 70, rotating in the direction as shown, advances a liquid developer material 18b from the chamber of development housing to development a zone or nip 22b. An electrode 24b positioned before the entrance to development zone or nip 22b is electrically biased to generate an AC field just prior to the entrance to development zone or nip 22b so as to disperse the toner particles substantially uniformly throughout the liquid carrier. The toner particles, disseminated through the liquid carrier, pass by electrophoresis to the previous developed image. The charge of the toner particles is opposite in polarity to the charge on the previous developed image.

A second conditioning high differential air pressure assisted device 26b contacts the developed image on belt 12 and conditions the image by compacting the toner particles of the image and reducing fluid content while inhibiting the departure of toner particles from the image. Preferably, the percent solids is more than 20 percent, however, the percent of solids can range between 15 percent and 40 percent. The images on belt 12 advances to lamp 76b where any residual charge left on the photoconductive surface is erased by flooding the photoconductive surface with light from lamp 76.

To similarly produce the third image using the third toner color, for example magenta color toner, the developed images on moving belt 12 are recharged with charging unit 17c, and re-exposed by a ROS 66c, which superimposes a third color image bitmap information over the previous developed latent image. At development station 20c, development roller 70, rotating in the direction as shown, advances a magenta liquid developer material 18c from the chamber of development housing to a development zone or nip 22c. An electrode 24c positioned before the entrance to development zone or nip 22c is electrically biased to generate an AC field just prior to the entrance to development zone or nip 22c so as to disperse the toner particles substantially uniformly throughout the liquid carrier. The toner particles, disseminated through the liquid carrier, pass by electrophoresis to the previous developed image. A conditioning high differential air pressure assisted device 26c contacts the developed images on belt 12 and conditions the images by reducing fluid content so that the images have a percent solids within a range between 15 percent and 40 percent. The images or composite image on belt 12 advances to lamp 76c where any residual charge left on the photoconductive surface of belt 12 is erased by flooding the photoconductive surface with light from the lamp.

Finally, to similarly produce the fourth image using the fourth toner color, for example cyan color toner, the developed images on moving belt 12 are recharged with charging unit 17d, and re-exposed by a ROS 66d. ROS 66d superimposes a fourth color image bitmap information over the previous developed latent images. At development station 20d, development roller 70, rotating in the direction as shown, advances a cyan liquid developer material 18d from the chamber of development housing to a development zone or nip 22d. An electrode 24d positioned before the entrance to development zone or nip 22d is electrically biased to generate an AC field just prior to the entrance to development zone or nip 22d so as to disperse the toner particles substantially uniformly throughout the liquid carrier. The toner particles, disseminated through the liquid carrier, pass by electrophoresis to the previous developed image. A conditioning high differential air pressure assisted device 26d contacts the developed images on belt 12 and conditions the images by reducing fluid content so that the images have a percent solids within a range between 15 percent and 40 percent.

The resultant composite multicolor image, a multi layer image by virtue of different color toner development by the developing stations 20a, 20b, 20c and 20d, respectively having black, yellow, magenta, and cyan, toners, is then advanced to an intermediate transfer station 78. It should be evident to one skilled in the art that the color of toner at each development station could be in a different arrangement.

At the transfer station 78, the resultant multicolor liquid image is subsequently electrostatically transferred to an intermediate member 80 with the aid of a charging device 82. Intermediate member 80 may be either a rigid roll or an endless belt, as shown, having a path defined by a plurality of rollers in contact with the inner surface thereof. It is preferred that intermediate member 80 comprise at least a two layer structure in which the substrate layer has a thickness greater than 0.1 mm and a resistivity of $10^6$ ohm-cm. An insulating top layer has a thickness less than 10 micron, a dielectric constant of 10, and a resistivity of $10^{13}$ ohm-cm. The top layer also has an adhesive release surface. Also, it is preferred that both layers each have a matching hardness less than 60 durometer. Preferably, both layers are composed of Viton™ (a fluoroelastomer of vinylidene fluoride and hexafluoropropylene) which can be laminated together.

The multicolor image on the intermediate transfer member 80 is conditioned again for example by a blotter roller 84 which reduces the fluid content of the transferred image by compacting the toner particles of the image while inhibiting the departure of toner particles from the image. Blotter roller 84 is adapted to condition the image so that it has a toner composition of more than 50 percent solids.

Subsequently, the multicolor image on the surface of the intermediate member 80 is advanced through a liquefaction stage before being transferred within a second transfer nip 90 to an image recording sheet 44. Within the liquefaction stage, particles of toner forming the transferred image are transformed by a heat source 88 into a tackified or molten state. The heat source 88 can be applied to member 80 internally, for example. Preferably, the tackified toner particle image is then transferred, and bonded, to recording sheet 44 with limited wicking by the sheet. More specifically, the liquefaction stage also includes an external heating element 89 which heats the external surface of the intermediate member 80 within a transfix nip 90 and to a temperature sufficient to cause the toner particles present on such surface to melt. The toner particles on the surface, while softening and coalescing due to the application of such heat internally and externally of the intermediate transfer member 80, ordinarily maintain the position in which they were deposited on the outer surface of member 80, thereby not altering the image pattern which they represent.

Within the transfixing nip 90, the multicolor image is not only transferred to the recording sheet 44, but it is also expected to be fused or fixed to acceptable fix levels by the application of appropriate heat and pressure. For example, at transfix nip 90, the liquefied toner particles are heated to a temperature of 80 to 100 degrees C., and are forced by a normal force applied through a backup pressure roll 94, into contact with the surface of recording sheet 44. Moreover, recording sheet 44 may have a previously transferred toner image present on a surface thereof as the result of a prior imaging operation, i.e. duplexing.

As the recording sheet 44 passes through the transfix nip 90 the tackified toner particles wet the surface of the recording sheet, and due to greater attractive forces between the paper and the tackified particles, as compared to the attraction between the tackified particles and a liquid-phobic surface of member 80, the tackified particles are completely transferred to the recording sheet 44. Furthermore, the transfixed image becomes permanent once allowed to cool below their melting temperature. As shown, the surface of the intermediate transfer belt 80 is thereafter cleaned by a cleaning device 98 prior to receiving another toner image from the belt 12.

Figure 3:
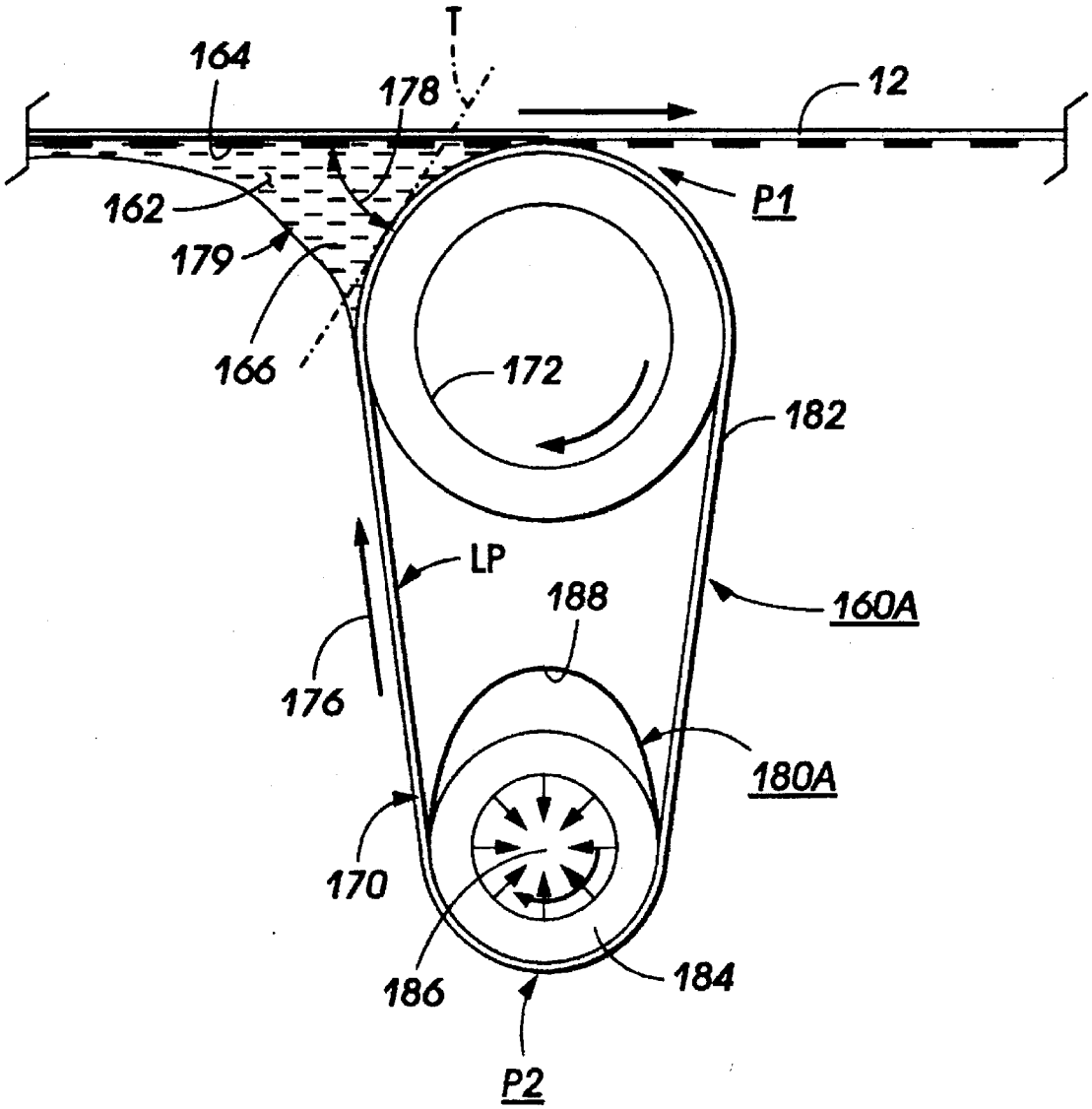
FIG. 3 is an enlarged illustration of a first embodiment of the high differential air pressure assisted blotting device of FIGS. 1 and 2.
Figure 4:
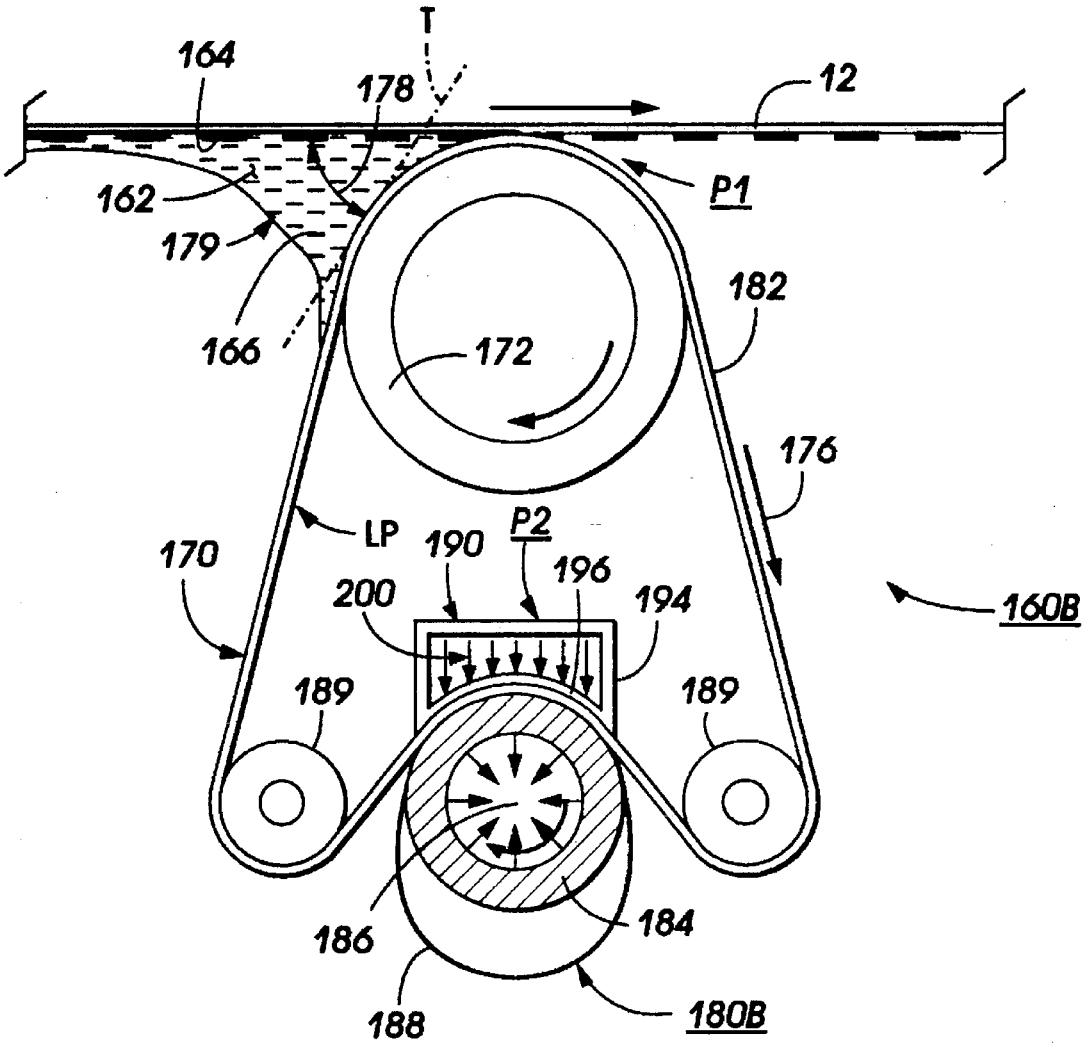
FIG. 4 is an enlarged illustration of a second embodiment of the high differential air pressure assisted blotting device of FIGS. 1 and 2.
Figure 5:
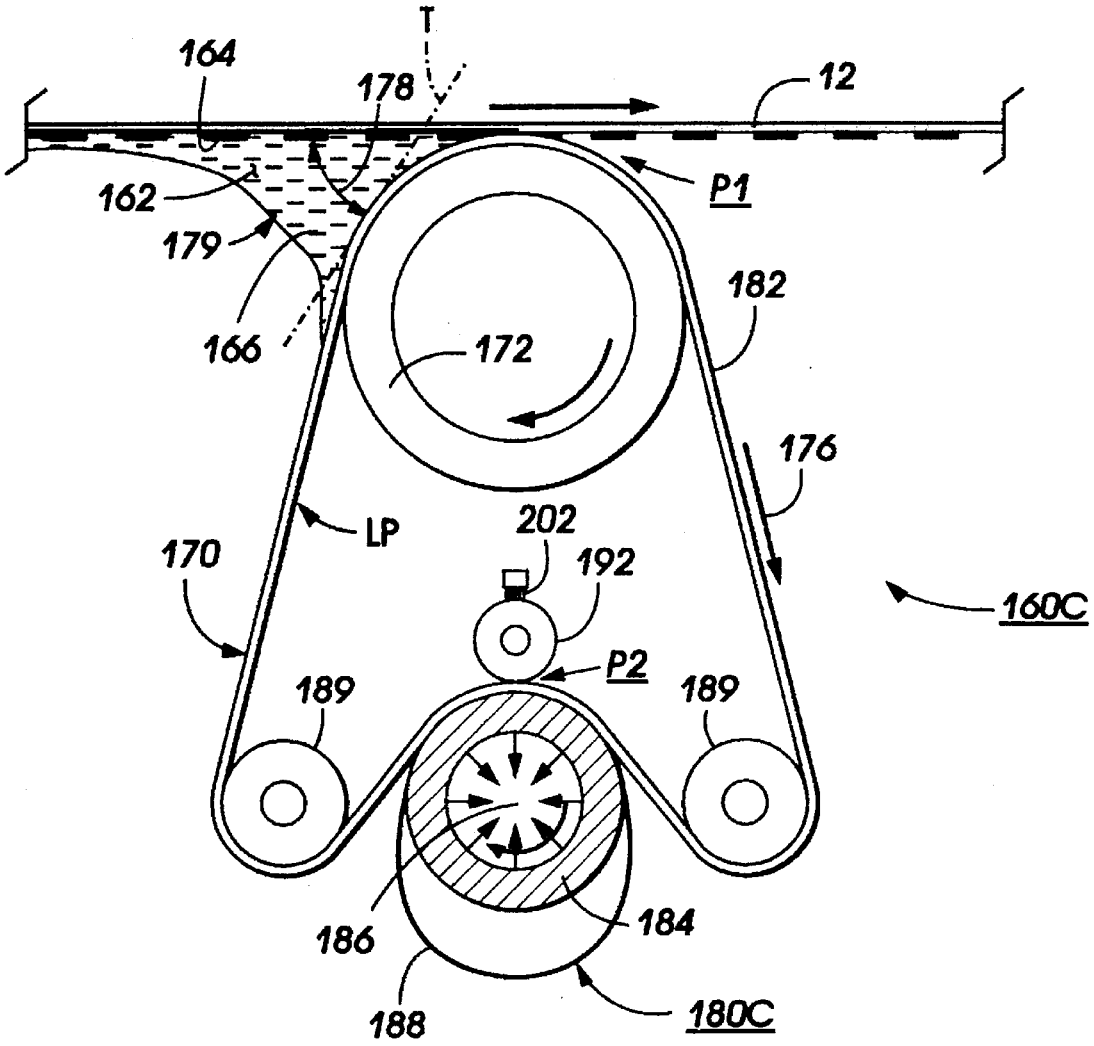
FIG. 5 is an enlarged illustration of a third embodiment of the high differential air pressure assisted blotting device of FIGS. 1 and 2.

Referring now to FIGS. 3 to 5, three different embodiments of the high differential air pressure blotting device 26, 40, 26*a*, 26*b*, 26*c*, 26*d* and 84 of the present invention are illustrated in greater detail, and are shown represented commonly as 160A, 160B and 160C respectively. As shown, each of the three embodiments of the high differential air pressure assisted blotting device 160A, 160B, 160C is suitable for conditioning on the image bearing member 12, liquid developer images 162 consisting of charged toner particles 164 and carrier liquid 166. Each of the embodiments of the high differential air pressure blotting device includes a movable porous blotter belt 170 that forms an endless loop LP, and that has an outer surface 182 for contacting and blotting carrier liquid 166 from a liquid developer image 162 being conditioned on the image bearing member 12. Each embodiment also includes a backup roller 172 positioned at a first location P1 within the endless loop LP so as to contact a first portion of the blotter belt for gently urging the blotter belt into blotting contact with the image being 162 conditioned.

Importantly, each embodiment of the high differential air pressure blotting device 160A, 160B, 160C; includes a high differential air pressure assembly 180A, 180B, 180C respectively, positioned at a second location P2 that is spaced from the image 162 being conditioned, and from the first location P1, so as to contact a second portion of the blotter belt 170 for applying high differential air pressure to such second portion. Applying such high differential air pressure operates effectively, and without concern about damage to the image being conditioned, to force substantially all carrier liquid 166 out the second portion of the blotter belt before such portion is moved back into blotting contact with the image bearing member 12

In each embodiment, the blotter belt 170 may be seamed or unseamed, and preferably has a width equal to that of the maximum image area. If seamed, then its circumference must be equal to an integral number of pitches or image frames of the image bearing member 12. The blotter belt 170 may consist of one or more layers, which may have different compositions. For example, blotter belt 170 may include a support layer (not shown) and at least a first absorbent foam layer (not shown) and a very thin surface layer having the surface 182 for contacting the image being conditioned. All the layers of the blotter belt 170 must be porous, and the pores of the surface layer preferably each have a size that needs not be small enough to sustain a vacuum, but must be small enough so image forming toner particles 164 cannot easily penetrate merely from blotting contact. The pores of the absorbent layer may be larger if there is the thin, small-pored surface layer or skin between the absorbent layer and the image. The absorbent and surface layers for example can consist of any polymeric foam, such as polyurethane, polytetrafluoroethylene (eg. Teflon(™) or Goretex (™) of Dupont, with or without internal additives. Ordinarily, the absorbent layer can be resistive, but if its thickness is 0.5 mm, it will need to be conductive. It is preferred that the overall contact of the blotter belt 170 with the image being conditioned have a compliant feel to it. The blotter belt 170 should be steered and effectively constrained from disturbing the image by deviating laterally from an alignment with the image area of the image bearing member.

The backup roller 172 can be hard or conformable depending on the compliant nature of the blotter belt 170. Ordinarily, the backup roller 172 can be solid and impermeable, but preferably should be made porous and include provisions for applying a low level partial vacuum (not shown) to further assist the capability of the blotter belt 170 in removing carrier liquid from the image being conditioned. It however must be a cylindrical, and its wall thickness can vary from minimum required in order to retain structural integrity up to that of a solid cylinder. Minimum thickness is determined by a specified load to be applied to the backup roll. For example, the specified load applied can vary between 1 pound per square inch (psi) to 120 psi. Backup roller 172 preferably is conductive, and so should be made of a metal such as aluminum or stainless steel. In each of the embodiments 160A, 160B, 160C, the backup roller 172 is preferably the drive roller that is connected to a drive means (not shown) for moving the blotter belt 170 around and around in the direction of the arrow 176.

As further illustrated, a tangent T to the back up roller 172, along the upstream leg of the loop LP of the blotter belt 170 between the locations P1 and P2, forms a lap and an upstream angle 178 with the image bearing member 12 in which a meniscus 179 of carrier liquid to be blotted is accumulated. The angle 178 preferably is variable by repositioning the high differential air pressure assembly 180A, 180B, 180C, such that decreasing the angle increases the reach, and early blotting of the meniscus on the belt upstream of a nip formed by the backup roller and image bearing member 12.

Referring in particular FIG. 3 which illustrates the first embodiment 160A, the high differential air pressure assembly 180A consists of a porous carrier liquid pick-off roller 184 that is positioned at the second location P2 inside the loop LP so as to be in contact a passing portion of the inside surface the blotter belt 170. Roller 184 may be spring loaded against the belt 170 in order to provide constant belt tension around the loop. The high differential air pressure assembly 180A also includes a full vacuum source 186 (or 28 FIGS. 1 & 2) that is connected to the pick-off roller 184 for percolating or drawing carrier liquid out of the blotter belt 170, without risk of damage to the image. As illustrated, pick-off roller 184 is cylindrical and preferably hollow. It has a wall thickness that provides sufficient structural integrity to allow it to be loaded with larger effective load forces against the blotter belt 170 than can be safely used to load the backup roller 172 against the blotter belt 170 and liquid image at the location P1. Pick-off roller 184 can also be solid, but in any case it is preferably made of perforated sintered metal, ceramic or plastic material so as to be porous. The assembly 180A includes a backside vacuum seal member 188 to the roller 184 for concentrating vacuum air flow from the front surface layer 182 through the absorbent and support layers of the belt 170 into the vacuum source 186.

In the second and third embodiments 160B, 160C as illustrated in FIGS. 4 and 5 respectively, the high differential air pressure assembly 180B, 180C includes a fluid pick-off roller 184 that is positioned at the second location P2 outside of the loop LP so as to be in constant contact with a passing portion of the outside surface 182 the blotter belt 170. Positioned to the outside of the belt as such, the pick-off roller 184 additionally serves to effectively clean the outside surface 182 of the belt 170. Roller 184 may be spring loaded against the belt 170 in order to provide desired loading force levels against the belt 170. The high differential air pressure assembly 180B, 180C also includes a full vacuum source 186 that is connected to the pick-off roller 184 for percolating or drawing carrier liquid out of the blotter belt 170. As illustrated, pick-off roller 184 is cylindrical and preferably hollow. It has a wall thickness that provides sufficient structural integrity to allow it to be loaded with larger effective load forces against the blotter belt 170 than can be safely used to load the backup roller 172 against the blotter belt 170 and liquid image at the location P1. Pick-off roller 184 can also be solid, but in any case it is preferably made of perforated sintered metal, ceramic or plastic material so as to be porous.

The high differential air pressure assembly 180B, 180C also includes a backside vacuum seal member 188 to the roller 184 for concentrating vacuum air flow from the inside of the belt 170 through the support and absorbent layers of the belt, into the pick-off roller 184 and vacuum source 186. A pair of idler rollers 189 are positioned as illustrated, one on the upstream side and the other to the downstream side (relative to movement of belt 170) for enabling effective loading of the pick-off roller 184 into the outside surface 182 of the blotter belt 170.

Importantly, the second and third high differential air pressure assembly embodiments 180B, 180C respectively, each include a positive pressure applying member 190, 192 respectively that is positioned inside the loop LP, and directly across from the pick-off roller 184. In the second embodiment (FIG. 4) the positive pressure applying member as illustrated is a source of high positive air pressure including a plenum 194 that has a shoe type surface 196 contoured to follow the wrap of the belt 170 around an arc of the pick-off roller 184. The member 190 thus applies positive air pressure shown as 200 from the inside to the outside of the belt 170 so that its air flow is in the same direction as air flow due to the vacuum source 186 of the pick-off roller 184. With this arrangement, applied differential air pressure levels achieved are far greater than those achievable with a partial vacuum, and thus far more carrier liquid can be removed from the belt 170. In fact, depending on the level of differential air pressure, the effect on the blotter belt 170 can actually amount to a drying effect. Such a drying effect of course advantageously enhances the absorbency of the dried portion of the belt 170 before it re-enters the blotting lap or nip 178. As Shown, in the third embodiment, the positive pressure member 192 is a spring (shown as 202) loaded roller that applies physical mechanical pressure, instead of positive differential air pressure, to additionally push or squeeze carrier liquid from the inside towards the outside of the belt 170 or in the same direction as carrier liquid flow due to the full vacuum source 186.

Referring now to FIGS. 1 to 5, the high differential air pressure assisted blotting devices 26, 26*a*, 26*b*, 26*c*, and 26*d* (which can be either embodiment 160A, 160B, or 160C as above) each operate in conjunction with a full vacuum 28 or 186 as disclosed above for effectively removing the liquid carrier from the liquid toner image without fear of image damage from loading forces or vacuum and air pressure levels. A bias voltage 29 is applied to each high differential air pressure assisted blotting device so that a repelling force is present to additionally prevent toner particles from leaving the photoconductive surface and entering the blotter belt 170 of the device.

Similarly, the high differential air pressure assisted blotting devices 40, 84 (which can be either embodiment 160A, 160B, or 160C as above) is each operated to absorb additional carrier liquid from what is already a high solids image at that point. In each, the solid backup roller 172, in accordance with the present invention, is more suitable structurally than a thin walled sintered metal and conventional blotter tube for applying the larger forces required to squeeze additional carrier liquid out of an-already conditioned image.

As can be seen, there has been provided in accordance with this invention, a high differential air pressure assisted blotting device 160A, 160B, 160C that in addition to removing carrier liquid (from an image being conditioned) by capillary absorption, greatly enhances such carrier liquid removal with high differential air pressure applied in a manner so as not to disturb the image being conditioned. Unlike conventional blotter devices, it is not limited by the absorption rate of the foam materials used therein, nor by image disturbing pressure levels. For example, pressure levels of 80–200 psi which are necessary to effectively remove carrier liquid from an absorbent foam layer of a blotter device, when applied directly against the image, are clearly likely to disturb the image.

While the embodiment disclosed herein is preferred, it will be appreciated from this teaching that various alternative, modifications, variations or improvements therein may be made by those skilled in the art, which are intended to be encompassed by the following claims:

What is claimed is:

1. A differential air pressure assisted blotting device for conditioning, on an image bearing member, liquid developer images consisting of charged toner particles and carrier liquid, the differential air pressure blotting device comprising:

(a) a movable porous blotter belt forming an endless loop and having an outer surface for contacting and blotting carrier liquid from an image being conditioned on the image bearing member;

(b) a backup roller positioned at a first location within said endless loop so as to contact a first portion of said blotter belt for urging said blotter belt into blotting contact with the image being conditioned; and (c) a differential air pressure assembly including a porous liquid pick-off roller mounted into contact with said blotter belt at a second location spaced from the image being conditioned in order to prevent damage to the image, and spaced from the first location so as to contact a second portion of said blotter belt said differential air pressure assembly including a vacuum seal mounted for sealing said pick-off roller against said blotter belt so as to concentrate vacuum air flow through said blotter belt into said pick-off roller for applying air pressure to such second portion to force carrier liquid out of second portion of said blotter belt.

2. The differential air pressure assisted blotting device of claim 1, wherein a tangent along an upstream leg of said loop to said back up roller forms an adjustable angle with the image bearing member for varying a reach of a carrier liquid meniscus on the blotter belt upstream of a contact nip between the blotter belt and the image bearing member.

3. The differential air pressure assisted blotting device of claim 1, wherein said differential air pressure assembly includes said porous liquid pick-off roller mounted into contact with said blotter belt, and a full vacuum source connected to said pick-off roller for vacuuming and drawing carrier liquid out of said blotter belt.

4. The differential air pressure assisted blotting device of claim 3, wherein said pick-off roller is mounted inside said loop of said blotter belt for contacting a backside of said blotter belt to vacuum and draw air from the outside front surface of said blotter belt, through said blotter belt, and into said pick-off roller.

5. The differential air pressure assisted blotting device of claim 3, wherein said pick-off roller is mounted outside said loop of said blotter belt for contacting a frontside surface of said blotter belt to vacuum and draw air from the inside surface of said blotter belt, through said blotter belt and out of said frontside surface, and into said pick-off roller, thereby drying and cleaning said frontside surface.

6. The differential air pressure assisted blotting device of claim 5, including a source of positive pressure mounted inside said loop for applying positive pressure against said pick-off roller through said blotter belt.

7. The differential air pressure assisted blotting device of claim 6, wherein said source of positive pressure comprises a roller member urged mechanically against the backside of said blotter belt for applying such positive pressure.

8. The differential air pressure assisted blotting device of claim 6, wherein said source of positive pressure comprises a source of pressurized air for applying positive differential air pressure against said pick-off roller through said blotter belt.

9. The differential air pressure assisted blotting device of claim 8, wherein said source of pressurized air produces an air flow moving in the same direction as an air flow caused by said full vacuum source as connected to said pick-off roller.

* * * * *